US010047642B2

(12) United States Patent
Smith

(10) Patent No.: US 10,047,642 B2
(45) Date of Patent: Aug. 14, 2018

(54) ELECTRO-MECHANICAL HYDRAULIC VALVE LIFTER FOR PRECISE CONTROL OF FUEL CONSUMPTION

(71) Applicant: Christian Smith, Mattapan, MA (US)

(72) Inventor: Christian Smith, Mattapan, MA (US)

( * ) Notice: Subject to any disclaimer, the term of this patent is extended or adjusted under 35 U.S.C. 154(b) by 120 days.

(21) Appl. No.: 15/395,392

(22) Filed: Dec. 30, 2016

(65) Prior Publication Data

US 2018/0187577 A1 Jul. 5, 2018

(51) Int. Cl.

| | |
|---|---|
| ***F01L 1/14*** | (2006.01) |
| ***F01L 1/245*** | (2006.01) |
| *F01L 1/24* | (2006.01) |
| *F01L 13/00* | (2006.01) |
| *F01L 9/04* | (2006.01) |
| *F01L 1/46* | (2006.01) |

(52) U.S. Cl.

CPC ..... *F01L 1/245* (2013.01); *F01L 1/14* (2013.01); *F01L 1/146* (2013.01); *F01L 1/46* (2013.01); *F01L 2001/2427* (2013.01); *F01L 2001/2433* (2013.01); *F01L 2001/256* (2013.01); *F01L 2009/0421* (2013.01); *F01L 2009/0455* (2013.01); *F01L 2013/111* (2013.01); *F01L 2013/113* (2013.01); *F01L 2109/00* (2013.01); *F01L 2820/041* (2013.01); *F01L 2820/042* (2013.01)

(58) Field of Classification Search

CPC ..... F01L 1/14; F01L 1/146; F01L 2001/2427; F01L 2001/2433; F01L 2001/256; F01L 1/46; F01L 2009/0421; F01L 2009/0455; F01L 2013/111; F01L 2013/113; F01L 2109/00; F01L 2820/041; F01L 2820/042

USPC ..... 123/90.11, 90.12, 90.55, 90.58

See application file for complete search history.

*Primary Examiner* — Jorge Leon, Jr.

(74) *Attorney, Agent, or Firm* — Daniel N. Smith

(57) ABSTRACT

The invention relates to an improved system of electro-mechanical hydraulic valve lifters for piston engine automobiles that increases fuel economy and reduces fuel emissions. The electro-mechanical hydraulic valve lifters enclose a magnetorheological fluid chamber, containing magnetorheological fluid. A control module manages voltage sent to the magnetorheological fluid in the magnetorheological fluid chamber. The control module introduces various amounts of magnetic flux to the magnetorheological fluid in the magnetorheological fluid chamber. The magnetorheological fluid's viscosity changes based on the amount of magnetic flux applied to it from the electromagnets and, along with the magnetorheological fluid chamber spring, controls how much an intake and exhaust port of the spark plug engine opens to control the amount of fuel used and exhaust let out of the engine.

16 Claims, 15 Drawing Sheets

ELECTRO-MECHANICAL HYDRAULIC VALVE LIFTER FOR PRECISE CONTROL OF FUEL CONSUMPTION

FIELD OF THE INVENTION

The invention relates to an improved electro-mechanical hydraulic valve lifter for automobiles that increases fuel economy and reduces fuel emissions.

BACKGROUND OF INVENTION

The purpose of the current automotive technology is to limit gasoline use and to optimize the spark ignition automobile engine compression ratio. The compression ratio is the volume of the engine cylinder when the piston is at the bottom of its stroke to the volume in the cylinder when the piston is at the top of its stroke. In a conventional spark plug engine, the compression ratio and the amount of gas intake are fixed. With these two unchanging features, the typical light load dictates the amount of pumping losses and changes according to the size of the engine. Pumping losses are the result of a partial vacuum that occurs between the throttle and the combustion chamber. Pumping losses cause the engine to use some of its power used to drive the automobile forward towards overcoming the piston's drag and the crank resistance by drawing in air resulting in half of the power potential loss.

The current automotive technologies that aid in increased fuel economy and reduce fuel emissions through a decrease in gas utilization have become more complex. Maintenance costs increase with engine complexity. Thus, automobiles with fuel economy technology have additional associated maintenance costs as they become more automated. Therefore the development of an inexpensive and less complex electro-mechanical device that increases fuel economy, while decreasing fuel emission and automobile automation, would simplify automobile maintenance and the accessibility of engines today.

The present invention is directed to increase fuel economy and reduce emissions for spark ignition engines. An electro-mechanical hydraulic valve lifter has the potential to increase fuel economy and reduce emissions for spark ignition engines at both the pre and post-market production phases. This is due to the fact that the electro-mechanical valve lifter's components and its subsequent assembly are installable in spark-ignition engines during all phases of production. Almost no modifications of the engine or its neighboring components would be needed. The electro-mechanical hydraulic valve lifter would appeal to the automobile consumer due to simplified maintenance requirements and its similarity to variable valve timing and lift, and variable displacement in terms of performance outcomes.

SUMMARY OF THE INVENTION

There are additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

The subject invention discloses a system of electro-mechanical hydraulic valve lifters for varying the opening of intake and exhaust valves for a piston engine, the system comprising: a plurality of electro-mechanical hydraulic valve lifters, each lifter comprising a hollow body, a hollow plunger slidably enclosed within the body, a hollow magnetorheological fluid chamber slidably enclosed within the plunger, wherein the magnetorheological fluid chamber contains magnetorheological fluid sealed within; a perforated piston slidably enclosed within the magnetorheological fluid chamber, and attached to a moveable rod attached to an intake/exhaust port, wherein the perforated piston compresses the magnetorheological fluid; at least electromagnet surrounding the body of each electro-mechanical hydraulic valve lifter, wherein each electromagnet is operatively attached to a control module, wherein the control module is operatively attached to at least one engine sensor; wherein the control module is configured to receive a plurality of signals from the at least one engine sensor, wherein the control module is configured to send various levels of voltage to the electromagnets to control the viscosity of the magnetorheological fluid to control the compression of the perforated piston, to control the intake/exhaust port.

The subject invention also discloses a system of electro-mechanical hydraulic valve lifters for varying the opening of intake and exhaust valves for a piston engine, the system comprising: a plurality of electro-mechanical hydraulic valve lifters, each lifter comprising a substantially cylindrical and hollow body, a substantially cylindrical and hollow plunger slidably enclosed within the body, a substantially cylindrical and hollow magnetorheological fluid chamber slidably enclosed within the plunger, wherein the magnetorheological fluid chamber contains magnetorheological fluid sealed within; a perforated piston slidably enclosed within the magnetorheological fluid chamber, and attached to a moveable rod attached to an intake/exhaust port, wherein the perforated piston compresses the magnetorheological fluid; at least one substantially cylindrical electromagnet encircling the body of each electro-mechanical hydraulic valve lifter, wherein each electromagnet is operatively attached to a control module, wherein the control module is operatively attached to at least one engine sensor; wherein the control module is configured to receive a plurality of signals from the at least one engine sensor, wherein the control module is configured to send various levels of voltage to the electromagnets to control the viscosity of the magnetorheological fluid to control the compression of the perforated piston, to control the intake/exhaust port.

The subject invention further discloses a method for controlling the opening of intake and exhaust ports of a spark plug engine comprising the steps of: detecting engine performance with a crankshaft sensor and a camshaft sensor; transmitting engine performance signals to a control module; transmitting varying levels of voltage from the control module to electromagnets on a plurality of electro-mechanical hydraulic valve lifters based on the signals received from the crankshaft and camshaft sensors; wherein each lifter comprises a hollow body, a hollow plunger slidably enclosed within the body, a hollow magnetorheological fluid chamber slidably enclosed within the plunger, wherein each magnetorheological fluid chamber contains magnetorheological fluid sealed within; a perforated piston slidably enclosed within the magnetorheological fluid chamber, and attached to a moveable rod attached to an intake/exhaust port; and controlling the viscosity of the magnetorheological fluid by applying voltage from the control module to control the compression of the perforated piston to control the intake/exhaust port.

In further embodiments of the subject invention, the magnetorheological fluid chamber further comprises a spring configured to resist a compression motion of the perforated piston and assist the piston in returning to a neutral position.

In embodiments of the subject invention, the plunger further comprises a spring configured to resist a compression motion of the magnetorheological fluid chamber.

In additional embodiments of the subject invention, the control module is configured to vary the voltages sent to the electromagnets based on a detected speed of the engine.

In embodiments of the subject invention, the at least one sensor comprises a crankshaft sensor.

In other embodiments of the subject invention, the at least one sensor comprises a camshaft sensor.

In further embodiments of the subject invention, the control module is operatively attached to a crankshaft sensor and a camshaft sensor.

In embodiments of the subject invention, the system further comprises an engine control unit is configured to detect the speed of the engine by engine sensors and send a signal based on the detected engine speed to the control module.

An electro-mechanical hydraulic valve lifter requires hydraulic valve lifters to be modified in order to implement the magnetorheological (MR) fluid, electromagnets, and a module similar to a "distributorless timing" pack and coil module. The operation of the electro-mechanical hydraulic valve lifter is characterized by the push of a camshaft's cam lobes on the tappet body of the lifter, and the engine control unit's sensor reading of the camshaft's and crankshafts position and speed. When the engine control unit receives the data of the camshaft and crankshaft, it sends voltage signals to the control module dictating the proper amount of voltage to be applied to the lifters' electromagnets, which is based on the engines speed and cam lobe position. This allows the MR fluid to receive the proper amount of magnetic flux from the electromagnets so that the MR fluid is at the right viscosity for the current engine speed to control how much to drive the push rods, which varies the opening levels of the intake and exhaust valves.

The subject invention discloses an inexpensive and less complex electro-mechanical device that increases automotive fuel economy, while decreasing fuel emission and automobile automation, greatly simplifying automobile maintenance and the accessibility of spark ignition engines. It is an electro-mechanical hydraulic valve lifter with magnetorheological (MR) fluid, electromagnets, and a "distributor less timing" pack and coil module. The electro-mechanical hydraulic valve lifter interacts with the cam lobes of the camshaft in a spark plug engine. The electro-mechanical hydraulic valve lifter comprises a tappet body that is enclosed in electromagnets as the tappet body itself encloses an MR fluid chamber with MR fluid. The electro-mechanical hydraulic valve lifter has a control module that manages the voltage sent to the magnetorheological fluid in the MR fluid chamber. The electromagnets receive voltages from the hydraulic valve lifter control module and then, based on the engines load, apply various amounts of magnetic flux to the magnetorheological fluid in the MR fluid chamber from their electromagnetic field. The automobile's engine control unit dictates how much voltage for the control module to apply to the electromagnets based on inputs from the camshaft and crankshaft sensors. The magnetorheological fluid's viscosity changes based on the amount of magnetic flux applied to it from the electromagnets and, along with the MR fluid chamber spring, controls how much an intake and exhaust port of the spark plug engine opens therein, controlling the amount of fuel used and exhaust let out of the engine. The electro-mechanical hydraulic valve lifter can be installed in engines at all phases of production, with almost no modifications of the engine or its neighboring components.

In embodiments of the subject invention, the term "substantially" is defined as at least close to (and can include) a given value or state, as understood by a person of ordinary skill in the art. In one embodiment, the term "substantially" refers to ranges within 10%, preferably within 5%, more preferably within 1%, and most preferably within 0.1% of the given value or state being specified.

In embodiments of the subject invention, the term "relatively" is defined as a comparison of a property, or the proportion of a property between two components.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

These together with other objects of the invention, along with the various features of novelty, which characterize the invention, are pointed out with particularity in the claims annexed to and forming a part of this disclosure.

BRIEF DESCRIPTION OF THE DRAWINGS

Advantages of the present invention will be apparent from the following detailed description of embodiments thereof, which description should be considered in conjunction with the accompanying drawings, in which.

DETAILED DESCRIPTION OF THE EMBODIMENTS

Figure 1:
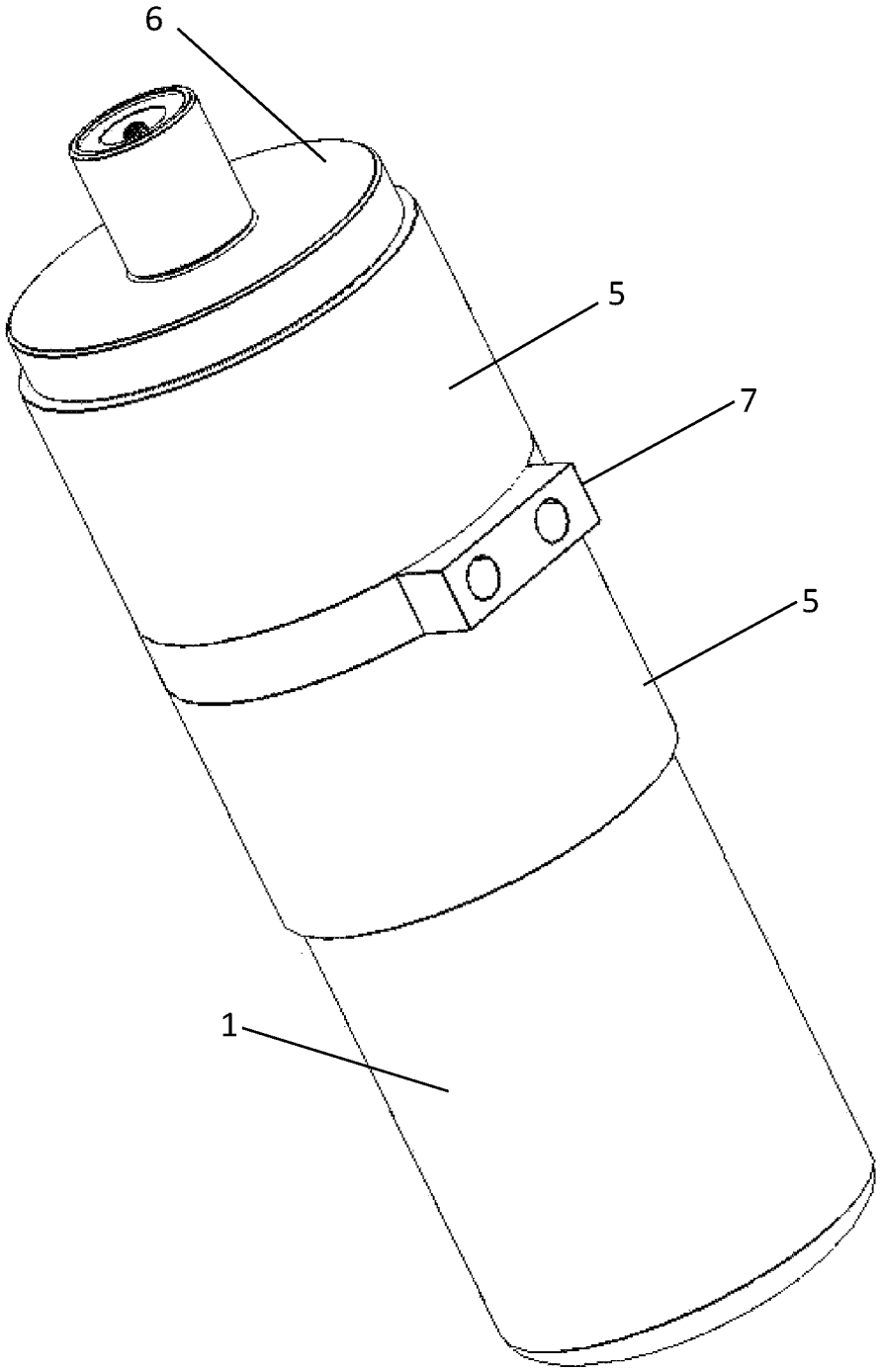
FIG. 1 is a top perspective view of an embodiment of the hydraulic valve lifter with no load.
Figure 2:
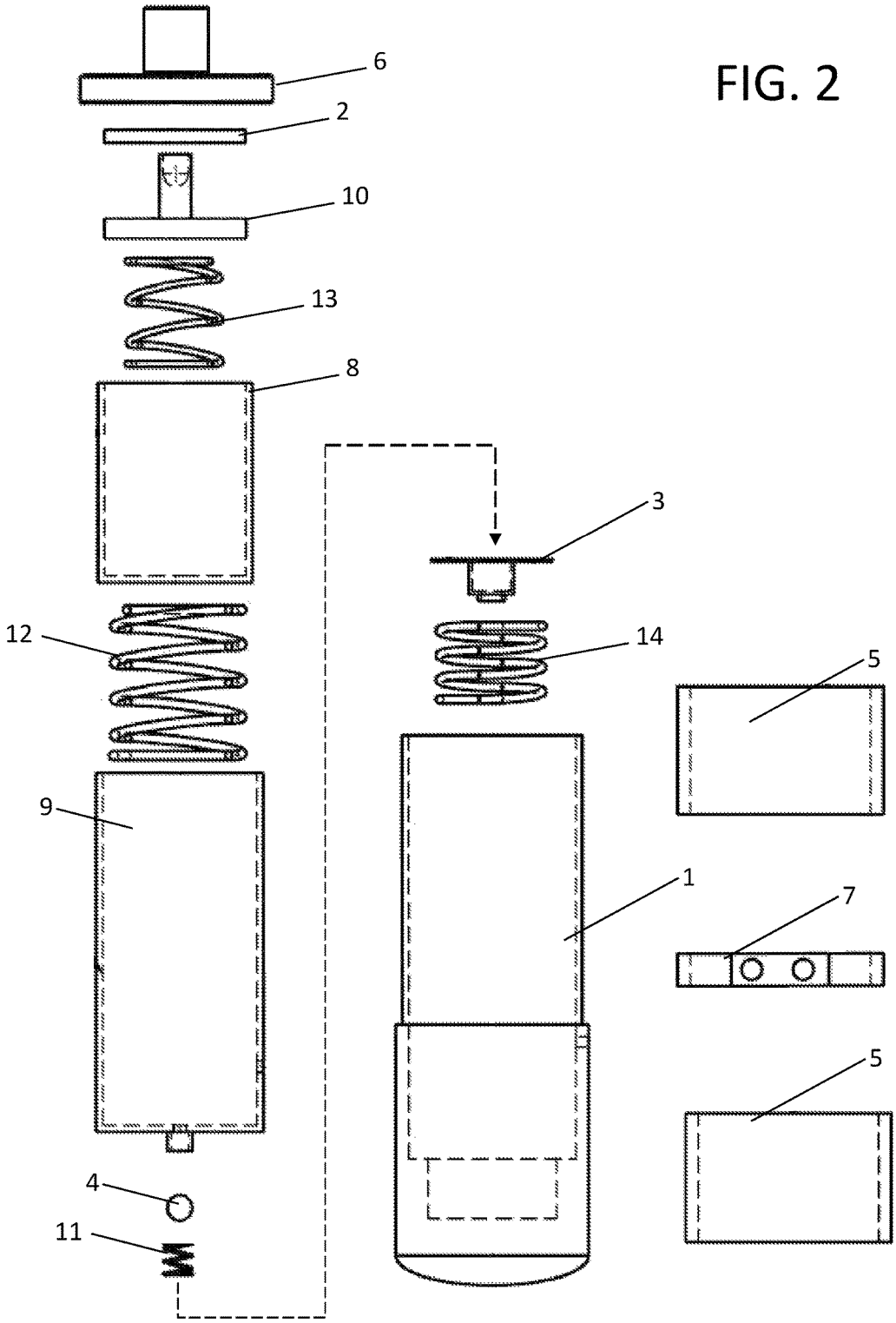
FIG. 2 is an exploded front view of the embodiment of the hydraulic valve lifter with no load.
Figure 3:
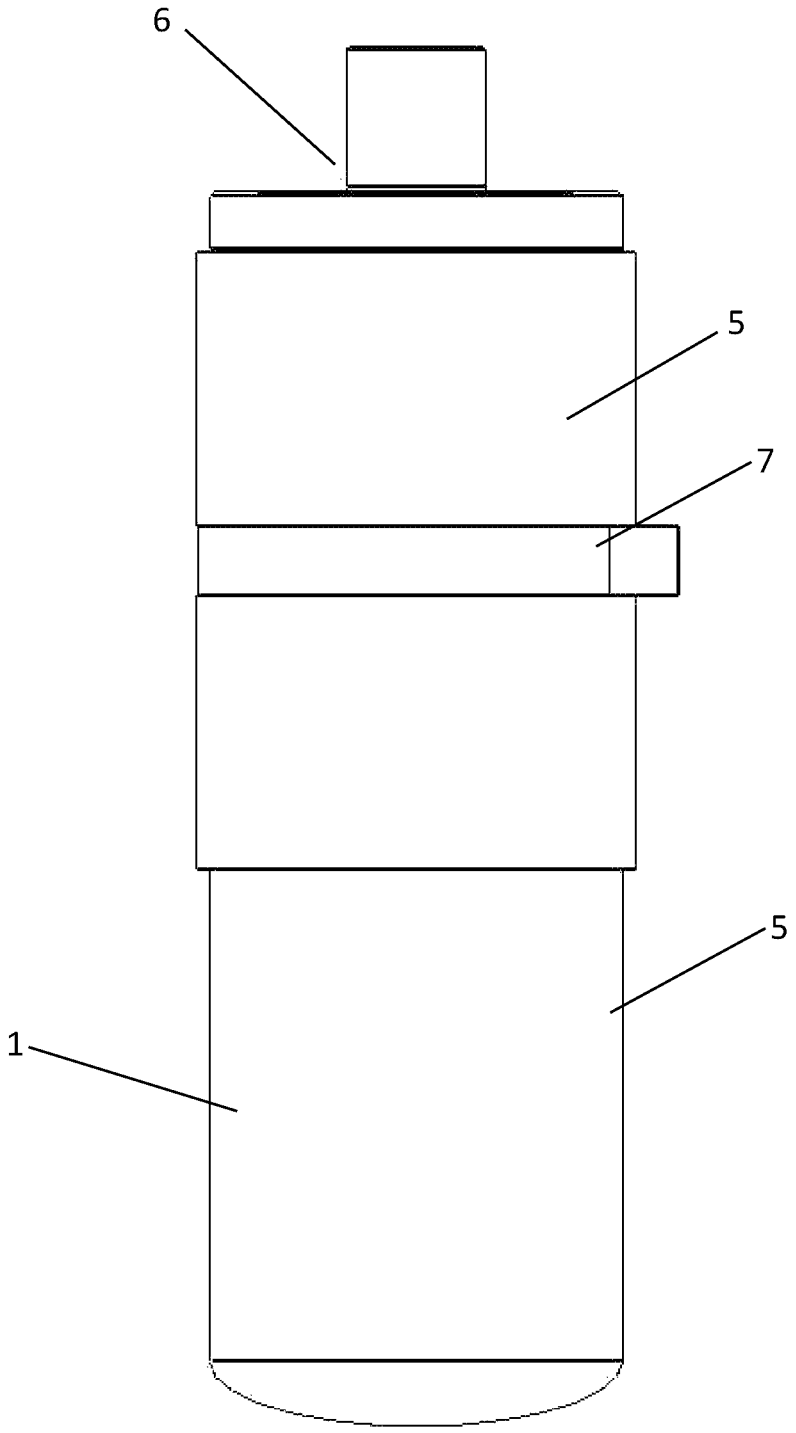
FIG. 3 is a side view of the embodiment of the hydraulic valve lifter with no load.

While several variations of the present invention have been illustrated by way of example in particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

The subject invention discloses inexpensive and less complex electro-mechanical device that increases automotive fuel economy, while decreasing fuel emission and automobile automation, greatly simplifying automobile maintenance and the accessibility of spark ignition engines.

As illustrated in FIGS. 1-15, the subject invention discloses an electro-mechanical hydraulic valve lifter 29 with a tappet body 1. The tappet body 1 may be hollow and substantially cylindrical in shape, with a top opening. The tappet body 1 encloses a high pressure chamber 23, which houses a check valve/ball retainer 3, a check ball/valve 4, a check ball/valve spring 11, and a check ball/valve retainer spring 14. In embodiments of the subject invention, the check valve/ball retainer 3 is substantially circular in shape, and the check ball/valve 4 is substantially spherical in shape. The check ball/valve spring 11 is attached, and provides compressive and restoring forces between the check valve/ball retainer 3 and the check ball/valve 4. The check ball/valve retainer spring 14 is attached, and provides compressive and restoring forces between the tappet body 1 and the check valve/ball retainer 3.

The tappet body 1 is encircled by two electromagnets 5 that are hollow and substantially cylindrical in shape. The electromagnets are both operatively connected to a wiring harness 7, which also encircles the tappet body 1, and applies voltage to the electromagnets 5.

Above the check ball/valve 4, the tappet body 1 holds a plunger 9. The plunger 9 may be hollow and substantially cylindrical in shape, with a top opening. The plunger 9 encloses an oil reservoir 22, a plunger spring 12, and a magnetorheological (MR) fluid chamber 8. The oil reservoir 22 receives and forces out oil out from oil holes 15 of the tappet body 1 and a plunger 9, but only when these holes 15 are aligned and the oil holes 15 are enclosed by the plunger 9. The plunger spring 12 is attached, and provides compressive and restoring forces between the plunger 9 and the magnetorheological (MR) fluid chamber 8.

The magnetorheological (MR) fluid chamber 8, within the plunger 9, may be hollow and substantially cylindrical in shape, with a top opening. The magnetorheological (MR) fluid chamber 8 contains the MR fluid chamber spring 13 and a perforated piston 10 that receives a pushrod 16 through a linear ball bearing 6. The magnetorheological (MR) fluid chamber 8 also contains magnetorheological (MR) fluid that is sealed within the chamber 8 by seal 2. The viscosity of the magnetorheological (MR) fluid in the magnetorheological (MR) fluid chamber 8 varies with the amount of voltage applied by the external electromagnets 5. The MR fluid chamber spring 13 is attached, and provides compressive and restoring forces between the magnetorheological (MR) fluid chamber 8 and the perforated piston 10.

The MR fluid chamber spring 13 has enough stiffness so that when various amounts of voltage are applied to electromagnets 5 with wiring harness 7, the perforated piston's 10 compression of the MR Fluid chamber spring 13 will vary directly with the amount of applied voltage to the electromagnets 5 as the MR fluid's viscosity changes in the MR fluid chamber 8. The MR fluid chamber spring 13 would also act to return the perforated piston 10 back to its neutral position after the nose of the cam lobe 17 has no contact with the tappet body 1.

Figure 7:
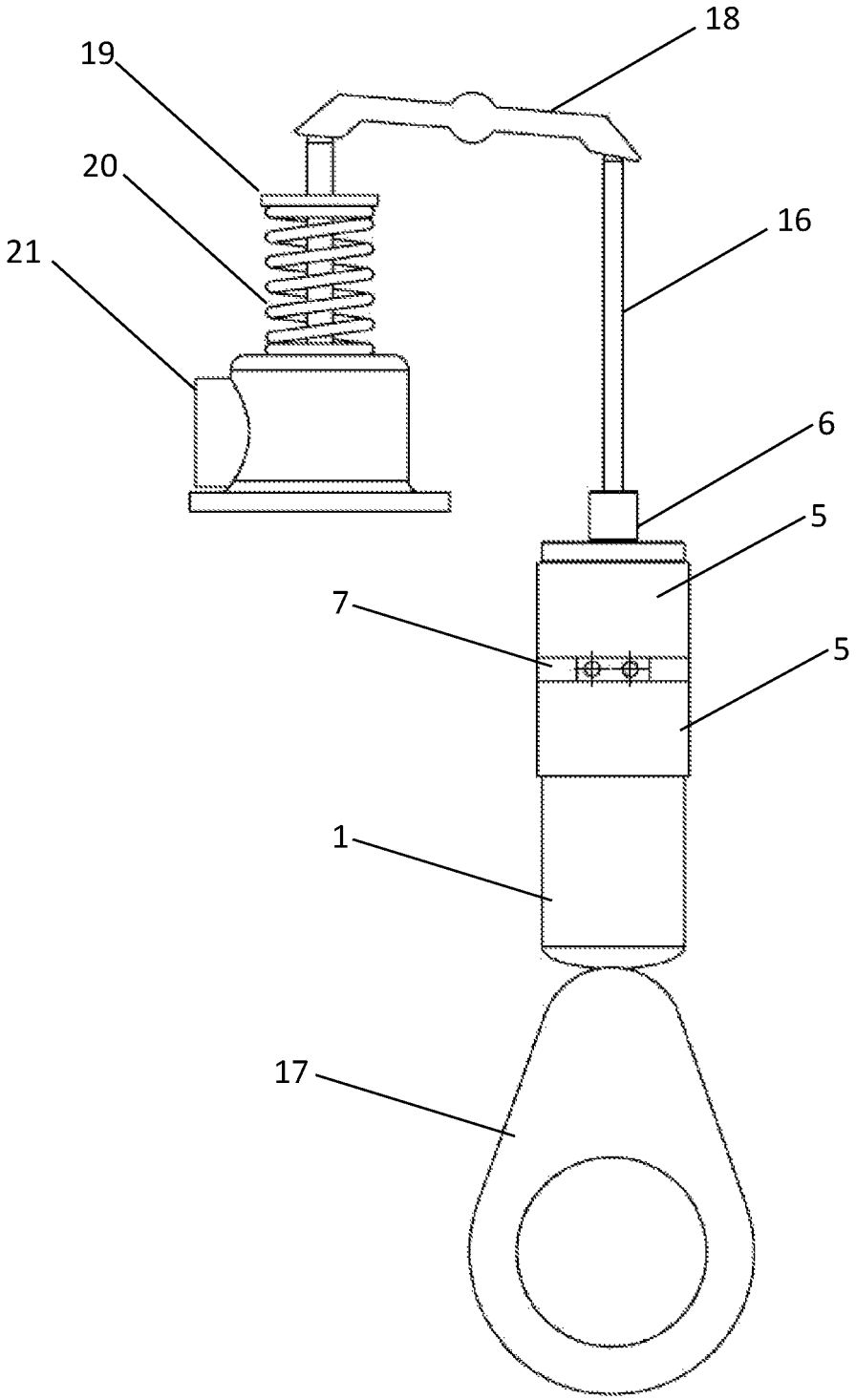
FIG. 7 is a front view of the hydraulic valve lifter in its camshaft-valve assembly position with the magnetorheological fluid deactivated in the MR fluid chamber, while undergoing cam lift.
Figure 10:
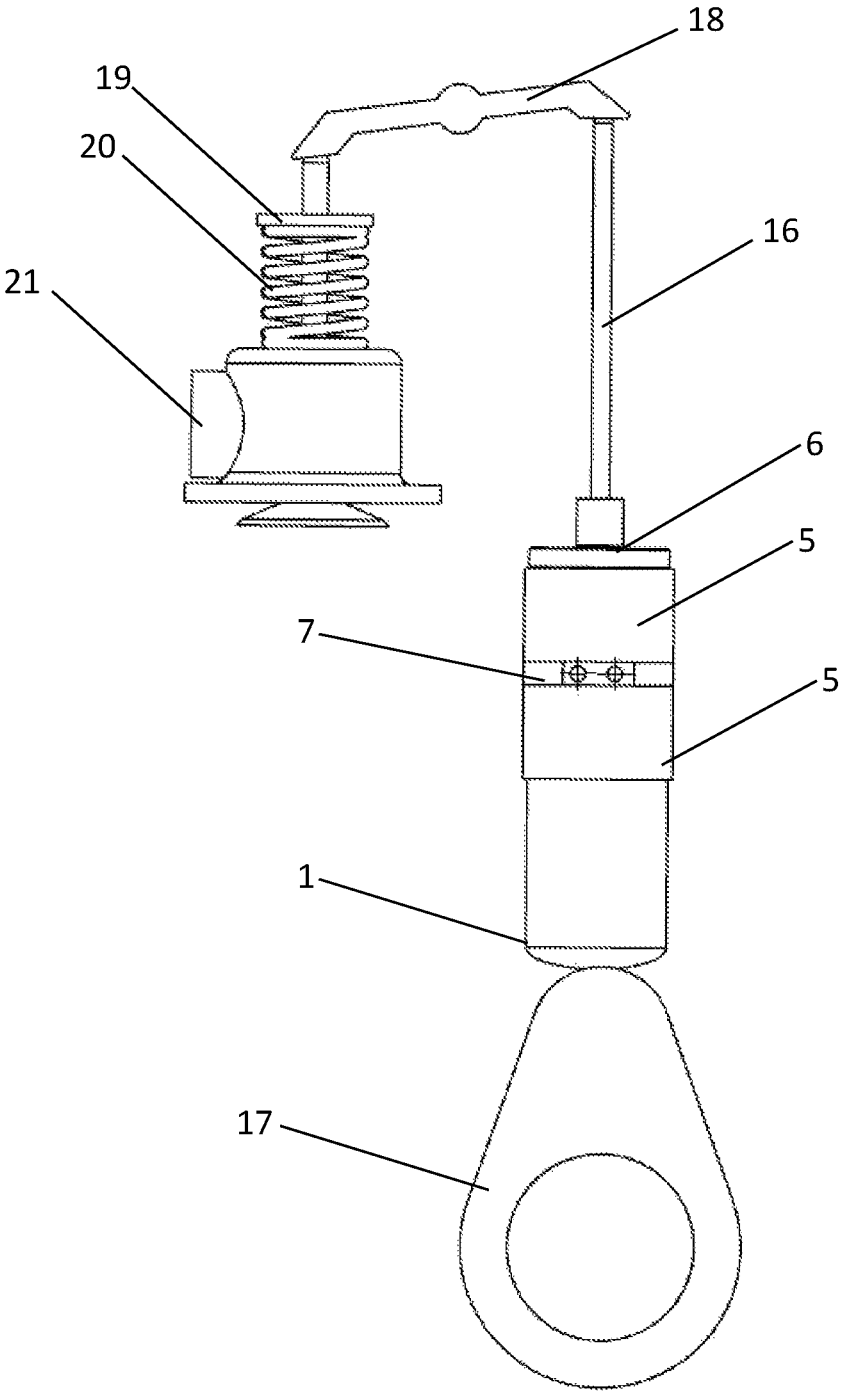
FIG. 10 is a front view of the hydraulic valve lifter in its camshaft-valve assembly position with the magnetorheological fluid activated in the MR fluid chamber, while undergoing cam lift.
Figure 13:
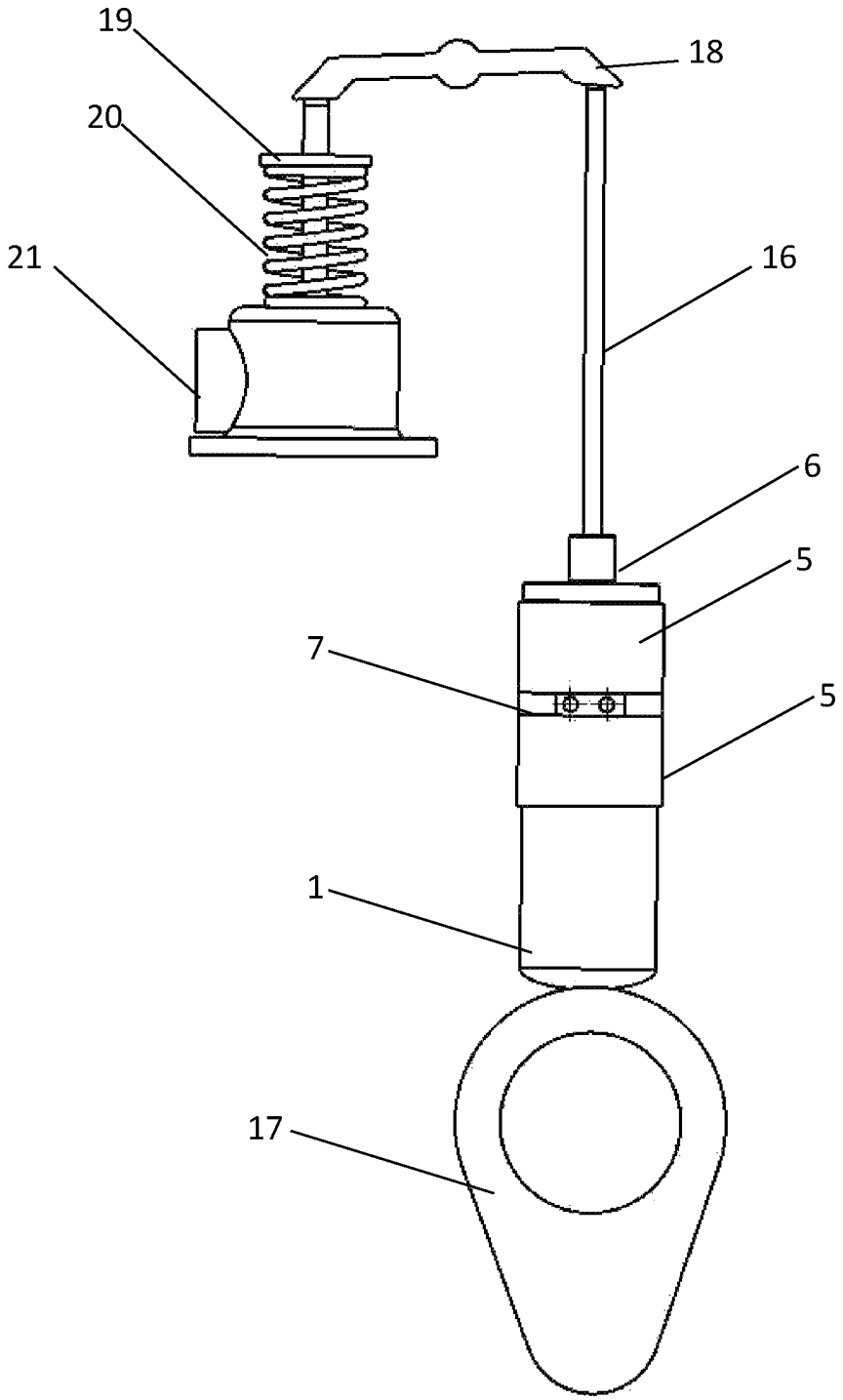
FIG. 13 is a front view of the hydraulic valve lifter in its camshaft-valve assembly position with no cam lift.

As illustrated in FIGS. 7, 10, and 13, the bottom of the tappet body 1 is in contact with the cam lobe 17. The push rod 16 is in contact with a rocker 18 that is attached to a valve 19, a valve spring 20, and an intake/exhaust port 21. Valve spring 20 is attached, and provides compressive and restoring forces between the valve 19 and the intake/exhaust port 21. The cam lobe 17 rotates and the hydraulic valve lifter control module 28 varies the MR fluids viscosity by sending the proper voltages to the electromagnets 5 based on the data from the cam 26 and crankshaft sensors 27.

Figure 4:
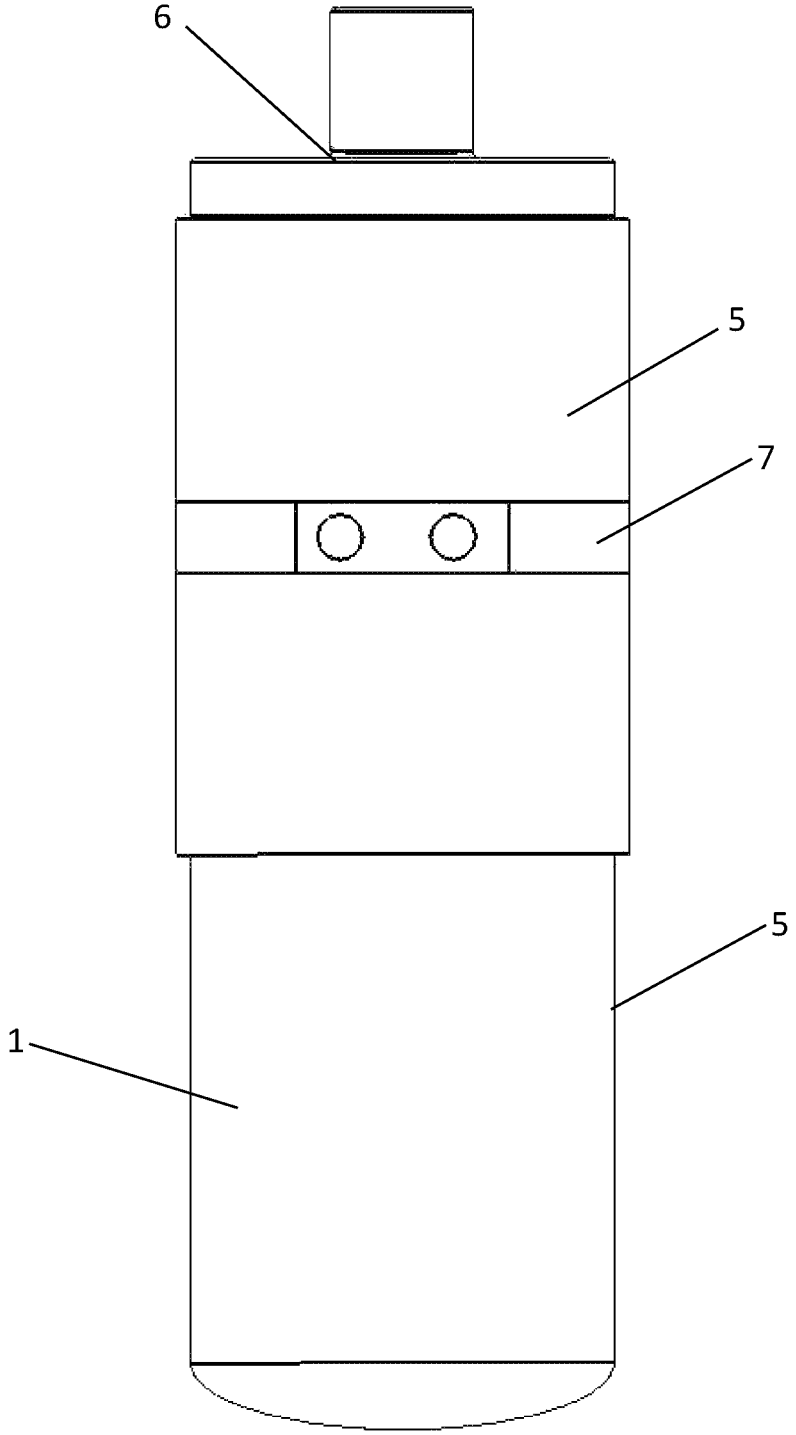
FIG. 4 is a front view of the embodiment of the hydraulic valve lifter with no load.
Figure 5:
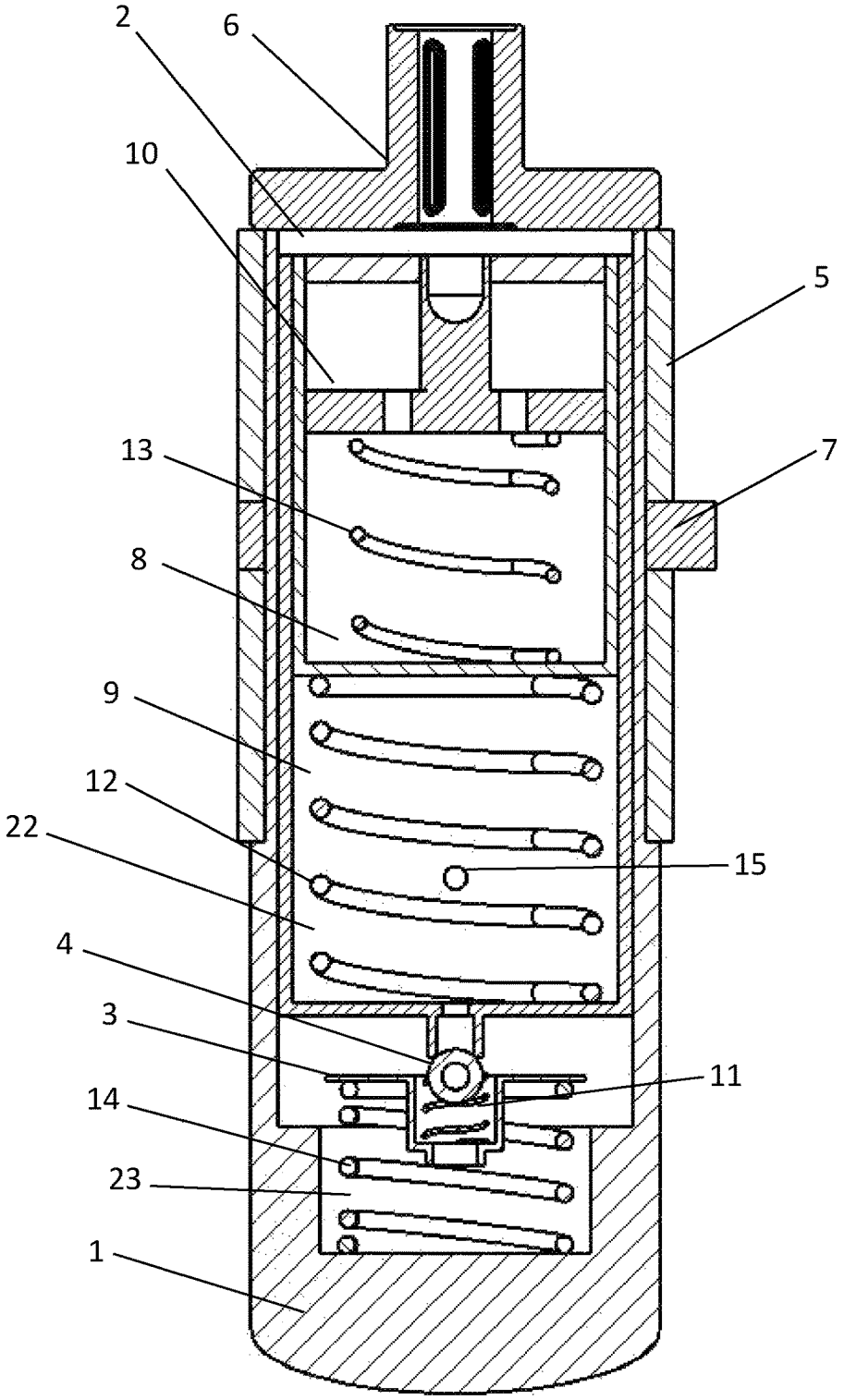
FIG. 5 is a front cross-sectional view of the embodiment of the hydraulic valve lifter with no load.
Figure 6:
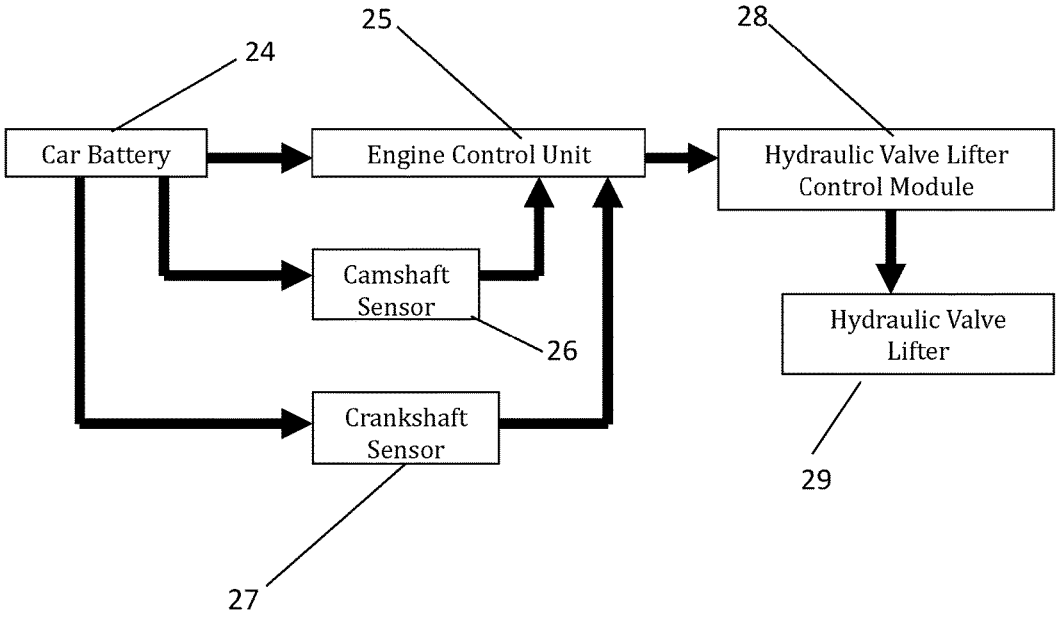
FIG. 6 is a flow chart diagram showing the relationship of the hydraulic valve lifter with other automotive components during operation.

As illustrated in FIG. 4, within an automobile (not shown), the electro-mechanical hydraulic valve lifter 29 is operatively attached to a hydraulic valve lifter control module 28. This control module 28 is operatively attached to an engine control unit 25, which receives data from both a camshaft sensor 26, and a crankshaft sensor 27. All of these units may be powered by the car battery 24.

Operation of the electro-mechanical hydraulic valve lifter 29 is as follows:

The camshaft sensor 26 and a crankshaft sensor 27 detect engine data, which is transmitted to the engine control unit 25. Based on the data received, the engine control unit 25 activates the hydraulic valve lifter control module 28 to control the electro-mechanical hydraulic valve lifter 29.

Figure 8:
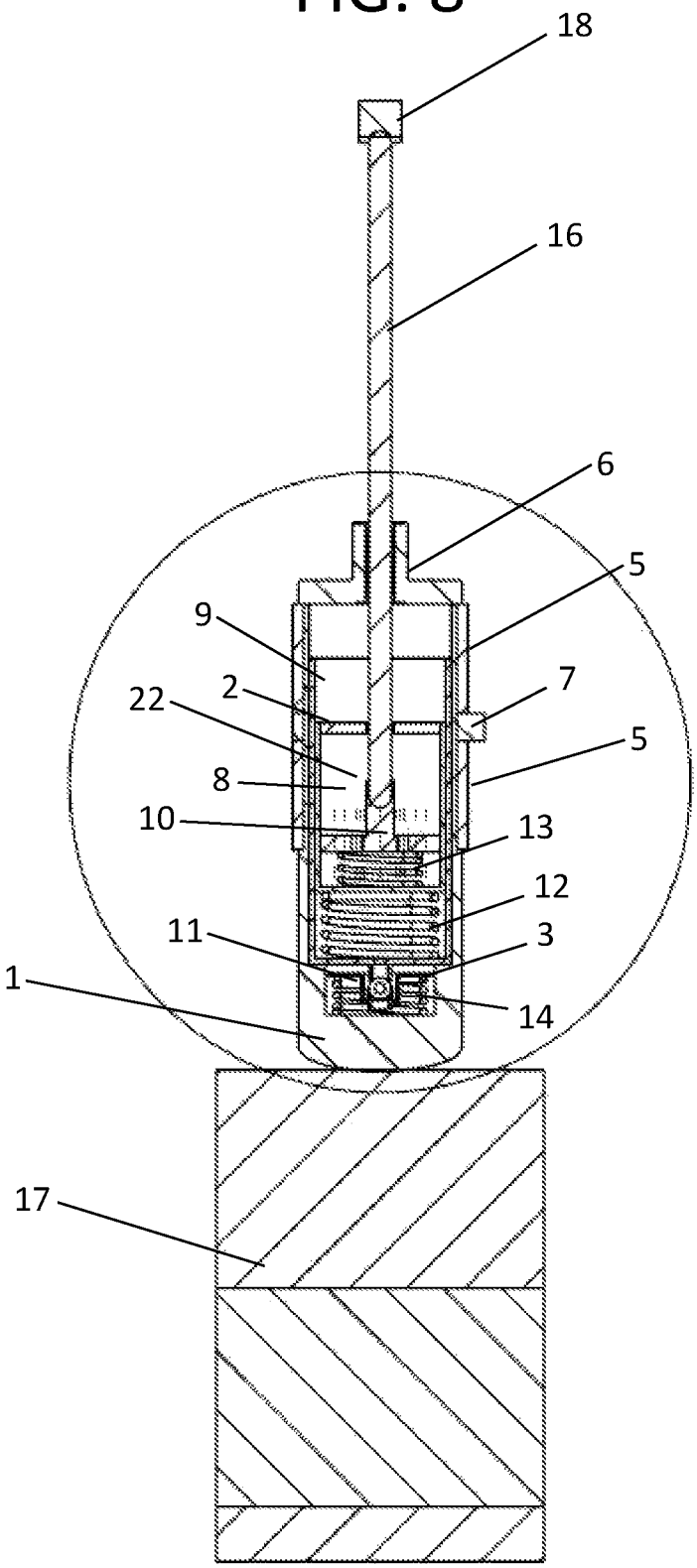
FIG. 8 is a front cross sectional view of the hydraulic valve lifter in its camshaft-valve assembly position with the magnetorheological fluid deactivated in the MR fluid chamber, while undergoing cam lift.
Figure 9:
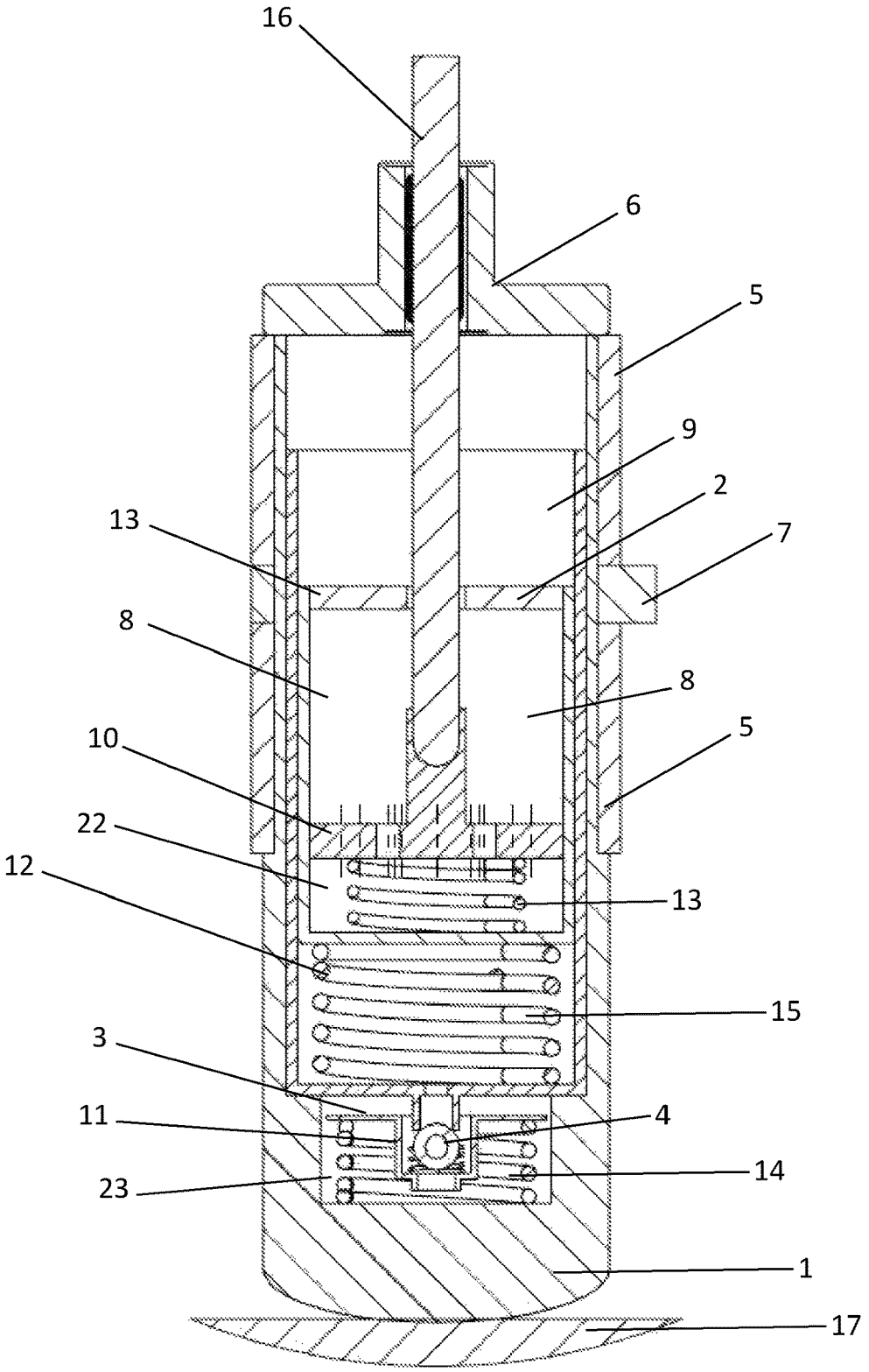
FIG. 9 is an expanded front cross-sectional view of the hydraulic valve lifter with the magnetorheological fluid deactivated in the MR fluid chamber, while undergoing cam lift.

FIGS. 7-9 illustrate the electro-mechanical hydraulic valve lifter 29 when the engine control unit 25 does not activate the hydraulic valve lifter control module 28 to provide voltage to the electromagnets 5 to magnetize the MR fluid. The perforated piston 10 is free to compress the MR fluid chamber spring 13 in the MR fluid chamber 8. This compresses the MR fluid chamber 8 against the plunger spring 12 and plunger 9. This compresses the plunger 9 against the check valve/ball retainer 3, the check ball/valve 4, and the check ball/valve spring 11. The downward movement of perforated piston 10 brings down push rod 16, which causes rocker 18 that is attached to pull up on valve 19 and a valve spring 20, which prevent intake/exhaust port 21 from opening.

Figure 11:
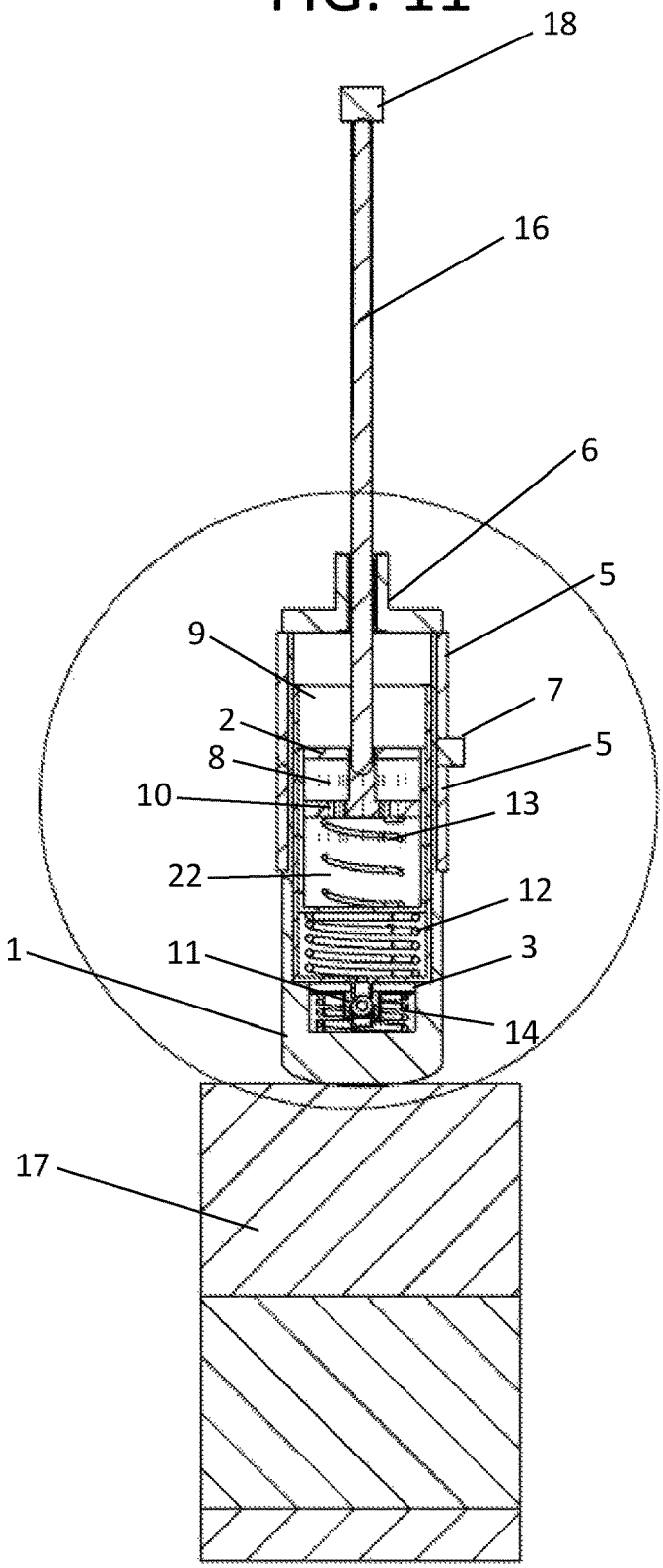
FIG. 11 is a front cross sectional view of the hydraulic valve lifter in its camshaft-valve assembly position with the magnetorheological fluid activated in the MR fluid chamber, while undergoing cam lift.
Figure 12:
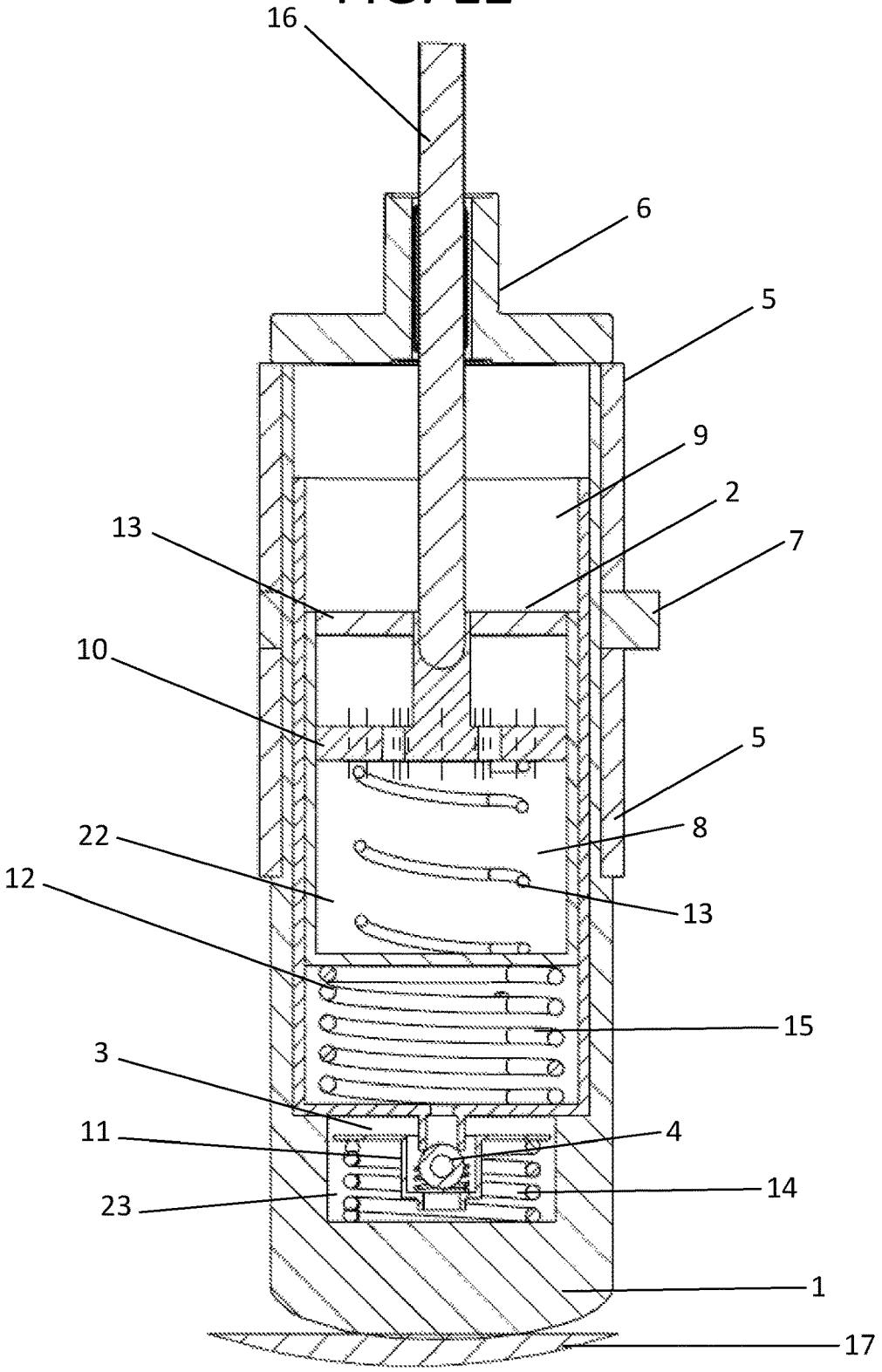
FIG. 12 is an expanded front cross-sectional view of the hydraulic valve lifter with the magnetorheological fluid activated in the MR fluid chamber, while undergoing cam lift.

FIGS. 10-12 illustrate the electro-mechanical hydraulic valve lifter 29 when the engine control unit 25 does activate the hydraulic valve lifter control module 28 to provide voltage to the electromagnets 5 through wiring harness 7 to magnetize the MR fluid within MR fluid chamber 8. Due to the applied voltage, the MR fluid's viscosity increases in the MR fluid chamber 8. The perforated piston 10 encounters more resistance as it goes down in the magnetized MR fluid in the MR fluid chamber 8. The combination of the spring's 13 stiffness and the increased viscosity of the MR fluid causes the perforated piston's 10 motion in the MR fluid chamber 8 to be impeded as magnetic flux on the MR fluid increases. This reduces compression of the MR fluid chamber 8 against the plunger spring 12 and plunger 9, which reduces compression of the plunger 9 against the check valve/ball retainer 3, check ball/valve 4, and the check ball/valve spring 11. The impeded downward movement of perforated piston 10 prevents push rod 16 from moving downward, which causes rocker 18 that is attached to a push down on valve 19 and a valve spring 20, which keeps intake/exhaust port 21 open.

Figure 14:
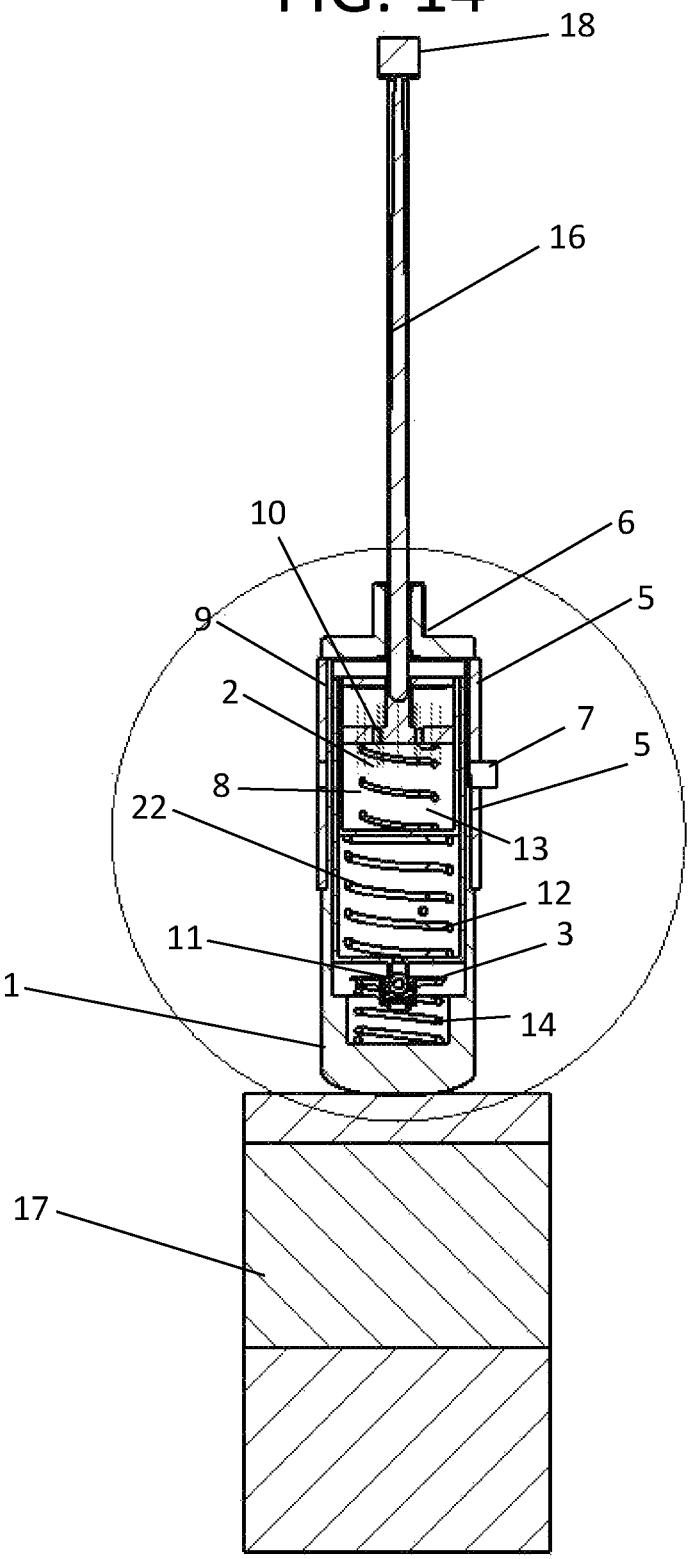
FIG. 14 is a front cross sectional view of the hydraulic valve lifter in its camshaft-valve assembly position with no cam lift.
Figure 15:
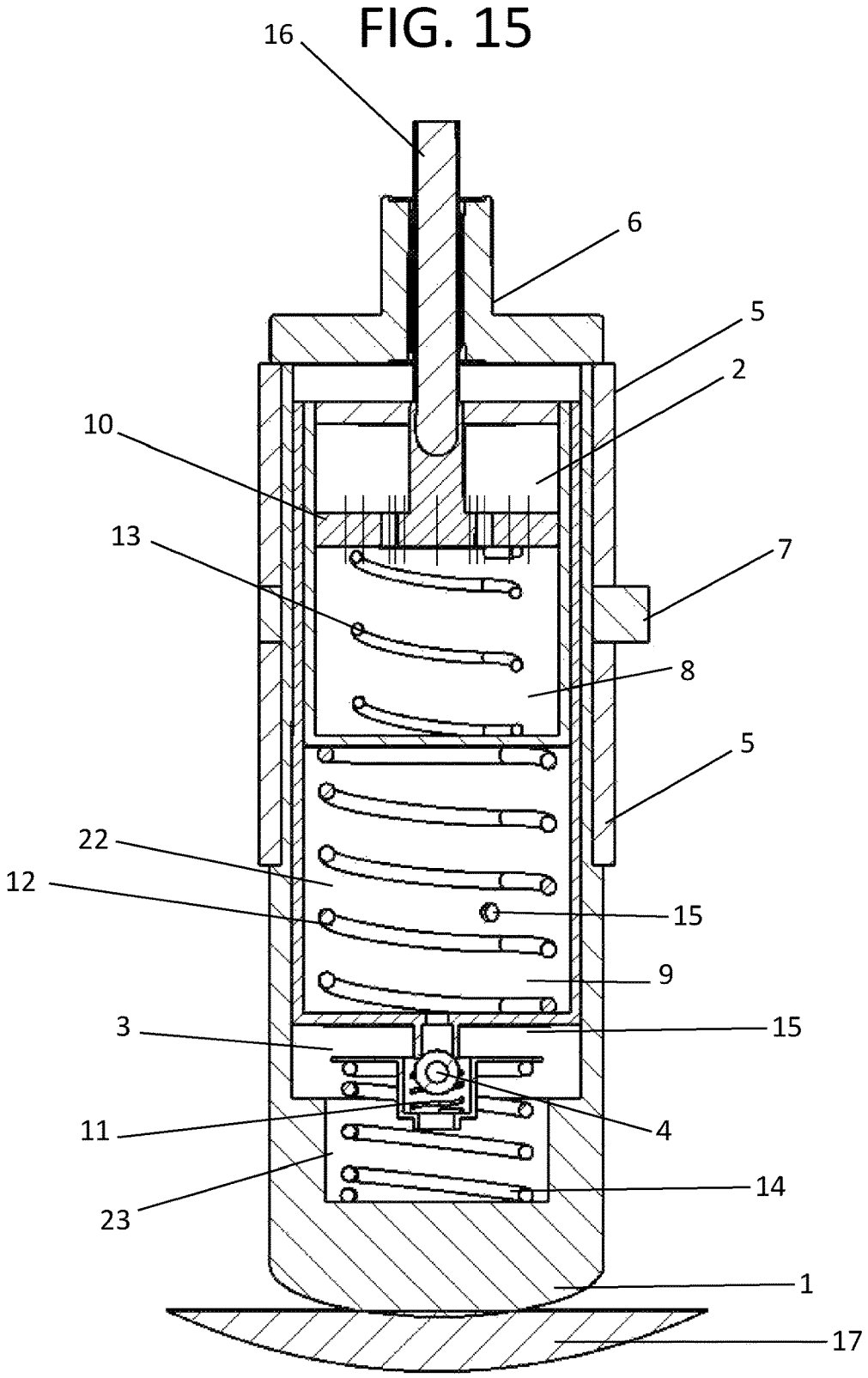
FIG. 15 is an expanded front cross-sectional view of the hydraulic valve lifter with no cam lift.

FIGS. 13-15 illustrate that when the cam lobe 17 is down, the intake and exhaust port 21 remains closed no matter the amount of magnetic flux that passes through the magnetorheological fluid in the MR fluid chamber 8.

When the cam lobe 17 pushes the hydraulic valve lifter up, it results in a varied amount of opening and closing of the intake and the exhaust ports 21. Thus the amount of fuel and exhaust used and let out could be precisely controlled to increase a spark ignition engine's fuel economy and decrease its emissions.

In embodiments of the subject invention, the electro-mechanical hydraulic valve lifter can be installed in engines at all phases of production, with almost no modifications of the engine or its neighboring components.

In embodiments of the subject invention, the tappet body 1, the fluid seal 2, the check valve/ball retainer 3, the check ball 4, the MR fluid chamber 8, the plunger 9, the perforated piston 10, the check ball spring 11, the plunger spring 12, the MR fluid chamber spring 13, the check valve/ball retainer spring 14, and the push rod 16 of the electro-mechanical hydraulic valve lifter may be made of stainless steel or other suitable material known to those skilled in the art.

In embodiments of the subject invention, the tappet body 1, the check valve/ball retainer 3, the check ball/valve 4, the check ball/valve spring 11, and the check ball/valve retainer spring 14 may be attached together by adhesives, welding, or other attachment means known to those skilled in the art. In embodiments of the subject invention, the tappet body 1, the two electromagnets 5, and the wiring harness 7 may be attached together by adhesives, welding, or other attachment means known to those skilled in the art. In embodiments of the subject invention, the plunger 9 and the plunger spring 12 may be attached together by adhesives, welding, or other attachment means known to those skilled in the art. In embodiments of the subject invention, the magnetorheological (MR) fluid chamber 8 and the MR fluid chamber spring 13 may be attached together by adhesives, welding, or other attachment means known to those skilled in the art.

In embodiments of the subject invention, the individual components of the electro-mechanical hydraulic valve lifter 29 may all be composed of a unitary construction.

The many aspects and benefits of the invention are apparent from the detailed description, and thus, it is intended for the following claims to cover such aspects and benefits of the invention, which fall within the scope, and spirit of the invention. In addition, because numerous modifications and variations will be obvious and readily occur to those skilled in the art, the claims should not be construed to limit the invention to the exact construction and operation illustrated and described herein. Accordingly, all suitable modifications and equivalents should be understood to fall within the scope of the invention as claimed here.

What is claimed is:

1. A system of electro-mechanical hydraulic valve lifters for varying the opening of intake and exhaust valves for a piston engine, the system comprising:

a plurality of electro-mechanical hydraulic valve lifters, each lifter comprising a hollow body, a hollow plunger slidably enclosed within the body, a hollow magnetorheological fluid chamber slidably enclosed within the plunger, wherein the magnetorheological fluid chamber contains magnetorheological fluid sealed within;

a perforated piston slidably enclosed within the magnetorheological fluid chamber, and attached to a moveable rod attached to an intake port or an exhaust port, wherein the perforated piston compresses the magnetorheological fluid;

at least one electromagnet surrounding the body of each electro-mechanical hydraulic valve lifter, wherein the at least one electromagnet is operatively attached to a control module, wherein the control module is operatively attached to at least one engine sensor;

wherein the control module is configured to receive a plurality of signals from the at least one engine sensor, wherein the control module is configured to send various levels of voltage to the at least one electromagnets to control a viscosity of the magnetorheological fluid to control the compression of the magnetorheological fluid by the perforated piston, to control the intake port or the exhaust port.

2. The system of electro-mechanical hydraulic valve lifters of claim 1, wherein the magnetorheological fluid chamber further comprises a spring configured to resist a compression motion of the perforated piston and assist the perforated piston in returning to a neutral position.

3. The system of electro-mechanical hydraulic valve lifters of claim 1, wherein the plunger further comprises a spring configured to resist a compression motion of the magnetorheological fluid chamber.

4. The system of electro-mechanical hydraulic valve lifters of claim 1, wherein the control module is configured to vary the voltages sent to the at least one electromagnet based on a detected speed of the engine.

5. The system of electro-mechanical hydraulic valve lifters of claim 1, wherein the at least one sensor comprises a crankshaft sensor.

6. The system of electro-mechanical hydraulic valve lifters of claim 1, wherein the at least one sensor comprises a camshaft sensor.

7. The system of electro-mechanical hydraulic valve lifters of claim 1, wherein the control module is operatively attached to a crankshaft sensor and a camshaft sensor.

8. The system of electro-mechanical hydraulic valve lifters of claim 1, wherein an engine control unit is configured to detect a speed of the engine by engine sensors and send a signal based on the detected engine speed to the control module.

9. A method for controlling an opening of intake and exhaust ports of a spark plug engine, the method comprising:

detecting engine performance with an engine sensor;

transmitting engine performance signals to a control module;

transmitting varying levels of voltage from the control module to electromagnets on a plurality of electro-mechanical hydraulic valve lifters based on the signals received from crankshaft and camshaft sensors; wherein each lifter comprises a hollow body, a hollow plunger slidably enclosed within the body, a hollow magnetorheological fluid chamber slidably enclosed within the plunger, wherein the magnetorheological fluid chamber contains magnetorheological fluid sealed within; a perforated piston slidably enclosed within the magnetorheological fluid chamber, and attached to a moveable rod attached to an intake port or an exhaust port; and controlling a viscosity of the magnetorheological fluid by applying voltage from the control module to control compression of the magnetorheological fluid by the perforated piston to control the intake port or the exhaust port.

10. The method of claim 9, wherein the magnetorheological fluid chamber further comprises a spring configured to resist a compression motion of the perforated piston and assist the perforated piston in returning to a neutral position.

11. The method of claim 9, wherein the plunger further comprises a spring configured to resist a compression motion of the magnetorheological fluid chamber.

12. The method of claim 9, wherein the control module is configured to vary the voltages sent to the electromagnets based on a detected speed of the engine.

13. The method of claim 9, wherein the engine sensor comprises a crankshaft sensor.

14. The method of claim 9, wherein the engine sensor comprises a camshaft sensor.

15. The method of claim 9, wherein the engine sensor comprises a crankshaft sensor and a camshaft sensor.

16. The method of claim 9, wherein an engine control unit is configured to detect a speed of the engine by engine sensors and send a signal based on the detected engine speed to the control module.

* * * * *